United States Patent [19]

Dumdum et al.

[11] Patent Number: 4,908,143

[45] Date of Patent: Mar. 13, 1990

[54] LUBRICATING COMPOSITIONS AND METHOD OF USING SAME

[75] Inventors: Josefina M. Dumdum, Chino Hills; Leah T. Mendelson, Santa Ana; Richard L. Pilling, Fullerton, all of Calif.

[73] Assignee: Union Oil Company of California, Brea, Calif.

[21] Appl. No.: 253,139

[22] Filed: Oct. 4, 1988

[51] Int. Cl.[4] ..... C10M 135/14

[52] U.S. Cl. ..... 252/17; 252/28; 252/29; 252/32.5; 252/34; 252/35; 252/38; 252/41; 252/42.7; 72/42

[58] Field of Search ..... 252/42.7, 35, 17

[56] References Cited

U.S. PATENT DOCUMENTS

| | | | |
|---|---|---|---|
| 3,525,690 | 8/1970 | Christian | 252/25 |
| 3,933,657 | 1/1976 | Seni et al. | 252/29 |
| 4,476,113 | 10/1984 | Young et al. | 424/161 |
| 4,507,214 | 3/1985 | Aldorf | 252/18 |
| 4,551,167 | 11/1985 | Young et al. | 71/903 |
| 4,726,144 | 2/1988 | Young et al. | 405/36 |
| 4,741,845 | 5/1988 | King | 252/18 |

OTHER PUBLICATIONS

Wills et al., Journal of the Chemical Society, vol. 1928 (II), pp. 2326–2332 (1928).

O'Donoghue et al., Journal of the Chemical Society, vol. 89 (II), pp. 1812–1818 (1906).

Yeoman, Journal of the Chemical Society, vol. 119, pp. 38–54 (1921).

*Primary Examiner*—William R. Dixon, Jr.
*Assistant Examiner*—Ellen M. McAvoy
*Attorney, Agent, or Firm*—Gregory F. Wirzbicki; Arthur E. Oaks; Michael H. Laird

[57] ABSTRACT

Additives comprising a salt or complex of tetrathiocarbonic acid are useful in lubricants to enhance both the extreme pressure/anti-wear and anti-oxidant capabilities thereof. The lubricants preferably are oils of lubricating viscosity, which may be thickened to grease-like consistency with one or more oil thickeners, and contain from about 0.1 to about 20 weight percent of said additives.

63 Claims, No Drawings

LUBRICATING COMPOSITIONS AND METHOD OF USING SAME

BACKGROUND OF THE INVENTION

1. Field of the Invention

This invention relates to lubricating compositions and more particularly lubricants having enhanced antiwear-/extreme pressure and/or anti-oxidant capabilities.

2. Description of the Prior Art

Over the years, the development of satisfactory lubricating oil and grease compositions for use under extreme pressure, high temperature and high speed conditions has received widespread attention Consequently, numerous additives have been proposed to enhance the physical and chemical properties of these compositions when intended for such service. Such additives are compounds that generally contain lead, sulfur, phosphorus, halogen (principally chlorine), and carboxylate salts, organic phosphates and phosphites. The list also includes chlorinated waxes, sulfurized unsaturated organic compounds, heavy metal sulfides such as lead sulfide and molybdenum disulfide, zinc dithiophosphate and antimony thioantimonate.

These additives, although effective under extreme pressure and high temperature conditions, have certain disadvantages. For example, environmental concerns make lead-containing additives undesirable. Antimony thioantimonate, another widely accepted additive for producing extreme pressure lubricants and greases, is expensive, thus significantly increasing the manufacturing costs of said lubricants. Because of its toxicity, disposal is also costly. There is therefore a need for lubricating additives which are environmentally benign and inexpensive to use. The present invention provides such an additive.

SUMMARY OF THE INVENTION

The present invention is an extreme pressure lubricating composition comprising a major amount of a lubricant and a minor amount of a metal salt or complex of tetrathiocarbonic acid, said composition being used to provide lubricants offering improved anti-wear/extreme-pressure (EP) protection for bearings, gears and other mechanical structures subjected to heavy sliding or rolling loads, and/or said lubricants providing an improved resistance to oxidation.

DETAILED DESCRIPTION OF THE INVENTION

The lubricating compositions of the present invention contain an oil of lubricating viscosity, a salt or complex of tetrathiocarbonic acid, and, when a grease, one or more thickeners.

The lubricating oils which form the major component of the lubricating compositions disclosed herein are typically those which have a viscosity within the range of about 35 to about 200 SUS at 210° F., said oils being derived from petroleum, shale, gasified coal, bitumen, tar sands, etc., and synthetic oils. Preferred petroleum base oils are derived from distillate lubrication oils which have an initial boiling point of about 350° F. to about 475° F., an endpoint in the range of about 500° F. to about 1100° F., and a flash point not lower than about 110° F.

Synthetic lubricating oils useful herein are derived from a product of chemical synthesis, i.e., manufactured oils. Typical examples of such compositions include polyglycol fluids such as polyalkylene glycols, silicones, which are a silicon-oxygen polymeric chain to which are attached hydrocarbon branches composed of either alkyl or phenyl groups, phosphates, polyphenyl esters, synthetic hydrocarbons and various esters of organic acids with alcohols.

When an additive is used to provide EP or other desirable properties to a lubricating oil, the lubricating oil preferably comprises at least 50 weight percent, more preferably at least 60 weight percent, and most preferably at least 70 weight percent of the lubricating composition. To form a grease, the lubricating oil is conveniently thickened to a grease consistency with an oil thickener. Generally two types of thickeners are used to form grease compositions, soaps and/or non-soaps.

A soap-base thickening agent as used herein is defined as being one or more metal soaps of saponifiable fats, oils or fatty acids capable of providing a stable gel structure to lubricating base oils. Typical fatty acids used herein are those which have carbon chains from about 10 to about 40 carbon atoms ($C_{10}$ to $C_{40}$), preferably from about 15 to about 30 atoms in length. Other saponifiable materials used in the manufacture of lubricating greases include distilled rosin oil, naphthenic acids, sulfonic acids, montan wax and wool wax.

The term soap-base is intended to include simple metal soaps, mixed-base soaps and complex soaps, as follows:

Simple metal soaps:

Soaps of aluminum, barium, calcium, lithium, sodium, lead, strontium and magnesium such as stearates, oleates hydroxystearates, acetates, sulfonates, azelates, acrylates, palmitates and benzoates.

Mixed-base soaps:

Soaps of two or more metals in mixtures of varying amounts such as stearates, oleates, hydroxystearates, acetates, sulfonates, azelates, acrylates, palmitates and benzoates of aluminum-calcium, aluminum-lead, aluminum-lithium, aluminum-sodium, aluminum-zinc, barium-aluminum, barium-calcium, barium-lithium, calcium-magnesium, calcium-sodium, lithium-aluminum, lithium-aluminum-lead, lithium-aluminum-zinc, lithium-calcium, lithium-potassium, lithium-sodium, sodium-barium, sodium-calcium, sodium-lead, sodium-lithium and sodium-zinc.

Complex soaps:

Soaps having dissimilar acid radicals associated with a single metal ion or those soaps mixed with low molecular weight salts or polar compounds, or such metal soaps formed from polycarboxylic acids. Examples include aluminum benzoate-stearate-hydroxide (aluminum complex), barium acetate-stearate (barium complex), calcium acetate-stearate (calcium complex) and dilithium azelate mixed with lithium borate (lithium complex).

Non-soap thickeners include all those thickeners that are not prepared by the process of saponification. Such materials include one or more organo-clays such as bentonite, kaolinite, montmorillonite, monazite and hectorite, polymers, polyurea, silica gel, carbon black, dyes and pigments.

In use, the oil thickener is generally mixed with the lubricating oil in an amount sufficient to impart a grease-like consistency to the oil, generally at a concentration between about 0.1 and about 30 weight percent of the combined lubricating composition and preferably between about 2 and about 20 weight percent.

The extreme pressure/anti-oxidation additives which impart enhanced properties to the lubricating compositions of the present invention comprise one or more salts of tetrathiocarbonic acid ($H_2CS_4$). The tetrathiocarbonates used herein may be prepared as solid salts by reacting a mixture, preferably a stoichiometric mixture, of a source of sulfide, preferably hydrogen sulfide, sulfur and carbon disulfide with a substituted metal oxide of the form $M(OR)_y$, wherein M is ammonium, quaternary ammonium, quaternary phosphonium or a metal, y, the valence of M, typically ranges from 1 to 4, preferably 1 or 2, and R is hydrogen or an organic radical. Preferably $M(OR)_y$ is an alkoxide in which R is an aliphatic radical having up to about 10 carbon atoms, preferably a saturated aliphatic radical, and more preferably an alkyl radical of up to about 5 carbon atoms, and said reaction is performed under conditions sufficient to produce the tetrathiocarbonate salt according to the general equation:

$$2M(OR)_y + y\ H_2S + y\ S + y\ CS_2 \Rightarrow M_2(CS_4)_y + 2y\ HOR \quad (1)$$

The tetrathiocarbonate ion can also act as a ligand to form complexes of the form:

$$(CI)_x(M_z(CS_4)_y)$$

wherein M is a complex-forming, cationic metallic element such as lead, tin or a transition metal such as iron, cobalt, nickel, platinum, copper, zinc, chromium, manganese, molybdenum, etc., with zinc, molybdenum, copper and iron being preferred, y is the number of tetrathiocarbonate groups in the complex, z is the number of atoms of M in the complex, CI is a neutralizing counter ion, preferably quaternary ammonium or quaternary phosphonium, and x is the number of counter ions necessary to neutralize the complex. These complexes have a variety of ligand-to-metal ratios depending upon the nature and valence of the cationic metal element used.

One method for the preparation of such complexes is by reacting a mixture of an alkali metal tetrathiocarbonate, prepared as described above, with a soluble complexforming metallic moiety and a soluble cationic counter ion, preferably one containing quaternary ionic groups of the form:

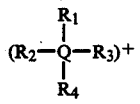

with Q being nitrogen or phosphorus and each R group being separately and independently hydrogen or, preferably, an organic radical, said organic radical preferably being an alkyl, aryl, cycloalkyl or alkylaryl group having up to about 50 carbon atoms. It is understood that other cationic counter ionic moieties such as alkali and alkaline earth metals may be substituted for quaternary ammonium or phosphonium, for example, by ion exchange techniques. Still other methods for preparing salts of tetrathiocarbonic acid and complexes are given in "Topics in Sulfur Chemistry," Vol. 2, pages 171–181, E. Sinning, ed., Publ. George Thieme, Stuttgart.

For compounds of the form $M_2(CS_4)y$, M, the salt-forming moiety, is preferably a metal, more preferably an alkaline earth and alkali metal. Most preferably, it is one or more alkali metals selected from lithium, sodium, potassium, cesium and rubidium, and very most preferably, it is potassium.

When an alkaline earth or alkali metal is used as the salt-forming cationic moiety, reaction (1) preferably takes place in an anhydrous alcohol such as absolute ethanol from which the tetrathiocarbonate salt precipitates as a free flowing yellow-orange powder. An alkoxide precursor such as potassium ethoxide, KOEt, may be generated in-situ by contacting potassium hydroxide with the alcohol, according to the reaction:

$$KOH + EtOH \Rightarrow KOEt + H_2O \quad (2)$$

Since the presence of water is found to cause significant problems in separating the reaction product, the water generated by reaction (2) must be removed prior to performing reaction (1). One approach for so doing is to heat the solution to a temperature high enough to cause an alcohol-water azeotrope to form and boil off. After the water is removed, the remaining reactants can be added, with the result that an easily handled, free-flowing powder is produced. Another approach is to avoid the formation of water by reacting the alkali or alkaline earth metal directly with the alcohol, with the reaction products being the desired alkoxide and hydrogen.

Reaction (1) may be carried out at a temperature from 0° C. to the boiling point of carbon disulfide, and preferably from about 15° C. to about 35° C. The reaction is preferably carried out under an inert or reducing gas atmosphere to avoid oxidation of any of the sulfur compounds to sulfur oxide moieties such as thiosulfate. At the conclusion of the reaction, the salt may be recovered from the alcohol suspension by filtration and drying. This should be done under an inert atmosphere to prevent oxidation or hydrolysis of the precipitated salt. When dry, the salt may be safely stored for extremely long periods prior to use. However, it must be kept away from oxygen and moisture since metal tetrathiocarbonates are hygroscopic and may either hydrolyze to form carbon disulfide or oxidize to form thiosulfates at ambient temperatures and humidities. This may be prevented either by coating the particles with the oil which will be used to form the final lubricating composition or by storing them in sealed containers, preferably under an inert atmosphere.

The tetrathiocarbonate salt or complex used comprises a minor part (i.e., less than 50 weight percent) of the lubricating composition, typically from about 0.1 to about 20 weight percent, preferably from about 0.5 to about 10 weight percent. Tetrathiocarbonate salts, in general, are easily mixed into grease compositions.

If desired, the additives described herein may be employed in conjunction with other additives commonly employed in lubricants. Thus, there may be added to the basic lubricants of this invention rust inhibitors, tackifiers, corrosion and other oxidation inhibitors and anti-wear/extreme-pressure agents. The only requirement to adding these additional additives herein is that they be compatible with the tetrathiocarbonate constituent of the lubricating composition.

The tetrathiocarbonate salts described herein enhance the extreme pressure properties of lubricating oils and greases used to protect mechanical components such as gears, bearings, threaded bolts and couplings, and the like, when subjected to sliding or rolling motion under very heavy loads from experiencing excessive wear.

In addition to being a grease component, the tetrathiocarbonate salts described herein may be dissolved or suspended in a lubricating oil. When a suspension is formed, conventional suspending agents, emulsion agents or suspension stabilizers are employed with the tetrathiocarbonate salt to ensure that a homogeneous mixture of lubricating oil and tetrathiocarbonate salt results.

The tetrathiocarbonate salts described herein may also be incorporated into lubricating pastes. Lubricating pastes, commonly referred to as "pipe dope," are used as thread lubricants, thread sealing and lubricating compounds, or tool joint compounds. Thread lubricants prevent structures comprising threaded metal parts such as pipes, couplings, nuts or bolts from galling, scuffing, and/or seizure during assembly and disassembly and also fill in any irregularities in the threads so that the joint will withstand high pressures. These lubricants generally contain an EP agent to prevent such damage.

The tetrathiocarbonic acid salts described herein, particularly those based on alkaline earth or alkali metal cations, offer still another advantage. They are environmentally innocuous, as shown by toxicology and environmental studies required by the EPA for registration as a soil fumigant. Such a use is described in U.S. Pat. No. 4,726,144, said patent being incorporated herein by reference.

The invention will be further described with reference to the following examples which are provided to illustrate and not limit the present invention.

EXAMPLE 1

Twenty grams (0.36 moles) of reagent grade potassium hydroxide was added to 200 grams of absolute ethyl alcohol, with the mixture being refluxed until all of the KOH had dissolved, after which the water formed was removed by a conventional water-alcohol azeotropic distillation. To the remaining alcoholic solution 5.7 grams (0.18 moles) of sulfur and 13.6 grams (0.19 moles) of carbon disulfide were added.

The mixture was then heated under reflux, with stirring, for about 20 minutes while 6.1 grams (0.18 moles) of hydrogen sulfide was added, after which a yellow-orange precipitate of potassium tetrathiocarbonate was formed. The precipitate was vacuum filtered, under an inert atmosphere, and washed 3 times with about 50 cc of pentane. The washed material was dried, under vacuum, for about 8 hours at 60° C., after which it was ready for use.

The potassium tetrathiocarbonate was then tested for extreme pressure (EP) properties in a grease composition comprising 7 weight percent lithium 12-hydroxy stearate and 93 weight percent SAE 40 oil (70 SUS at 210° F.) by determining the four-ball EP weld load and load wear index for the composition.

The weld load and load wear index, in Kg force, are determined by the ASTM D-2596 Four-ball EP test in which a steel ball, under a constant force or load, is rotated at a speed of 1770 RPM against 3 balls held in a stationary position in the form of a cradle. The temperature is maintained at 80° F., and the rotating ball is subjected to successively higher loads for 10 seconds until the four balls weld together. The results are summarized in Table 1 below:

TABLE 1

| | Composition, Wt. % | | | | |
|---|---|---|---|---|---|
| Lithium grease | 100 | 99.2 | 98.0 | 97.0 | 96.0 |
| Potassium tetrathiocarbonate | 0 | 0.8 | 2.0 | 3.0 | 4.0 |
| Four-ball weld load (Kg force) | 126–160 | 250 | 315 | 400 | 400 |
| Load wear index (Kg force) | 22.34 | 39.23 | 45.27 | 55.93 | 56.49 |

Note that the addition of as little as 2 weight percent of potassium tetrathiocarbonate more than doubles the weld load and load wear index values observed with the basic grease composition.

EXAMPLE 2

Four-ball EP tests as defined in Example 1 above were run with two lithium grease compositions compounded with antimony dialkylphosphorodithioate (Vanlube 622) and antimony dialkyldithiocarbamate (Vanlube 73), respectively, two widely used EP additives. With these, 400 Kg force loadings were achieved when their concentrations reached 2.5 weight percent, for Vanlube 622, and 4.0 weight percent for Vanlube 73. These data show that the addition of an alkali metal tetrathiocarbonate, in general, and potassium tetrathiocarbonate, in particular, achieves an EP capability in a conventional lithium grease which is at least equivalent to currently used EP additives.

EXAMPLE 3

Nine grams of zinc sulfate monohydrate (0.05 moles) and 45 grams of benzyl triphenyl phosphonium chloride (0.107 moles) were dissolved in 1200 cc of deionized water. After filtration to remove a small amount of insoluble material there was added, at room temperature and with stirring, 300 cc of an aqueous solution containing 0.51 moles of sodium tetrathiocarbonate prepared as described in U.S. Pat. No. 4,726,144. A yellow precipitate formed which after being separated by filtration was washed with water, ethanol and ether. After drying in a desiccator, the solid had a melting point of 145° to 152° C. A comparison of the elemental analysis of the solid and for one having the theoretical composition of $((C_6H_5)_3C_6H_5CH_2P)_2(CS_4)_2Zn$ is as follows:

| | Actual, wt. % | Theoritical wt. % |
|---|---|---|
| phosphorus | 5.9 | 5.88 |
| carbon | 59.6 | 59.32 |
| hydrogen | 4.1 | 4.22 |
| sulfur | 22.3 | 24.36 |
| zinc | 5.9 | 6.21 |

EXAMPLE 4

The basic oxidation stability of the lithium grease used in Example 1 was evaluated per the procedure of ASTM D942 against compositions containing 0.8 weight percent of the potassium tetrathiocarbonate as prepared in Example 1 and 0.8 weight percent of a commercial antioxidant, Ethyl 702. In this procedure, the samples are placed in a test bomb under about 110 PSI of oxygen and heated to about 210° F. for about 100 hours. The test parameter is the oxygen pressure drop with lower numbers indicating that less oxidation had occurred. In these tests the following results were observed:

| Grease Composition | ASTM D942 Results PSI drop after 100 hours |
|---|---|
| Base grease alone | 8–10 |
| Base grease + 0.8% Ethyl 702 | 5.0 |
| Base grease + 0.8% $K_2CS_4$ | 2.9 |

Note that as little as 0.8 weight percent of potassium tetrathiocarbonate, when added to the base grease produced a lubricant showing an oxygen pressure drop which is about 40 percent lower than that with an equal amount of the commercial antioxidant against which it was compared, and between about 60 and about 70 percent lower than that of the base grease alone.

Obviously many modifications and variations of this invention, as hereinabove set forth, may be made without departing from the spirit and scope thereof, and therefore only such limitations should be imposed as are indicated in the following claims. All embodiments which come within the scope and equivalency of the claims are, therefore, intended to be embraced therein.

We claim:

1. A lubricating composition comprising a major amount of a lubricant and a minor amount of a salt or complex of tetrathiocarbonic acid.

2. The lubricating composition of claim 1 comprising a salt of tetrathiocarbonic acid wherein the salt-forming moiety is selected from the group consisting of ammonium, quaternary ammonium, quaternary phosphonium and metals.

3. The lubricating composition of claim 1 comprising a complex of tetrathiocarbonic acid wherein the complex-forming moiety is selected from the group consisting of cationic complex forming metallic elements.

4. The lubricating composition of claim 1 wherein said lubricant comprises an oil of lubricating viscosity.

5. The lubricating composition of claim 1 wherein said lubricant is a grease comprised of an oil and one or more oil thickeners.

6. The lubricating composition of claim 5 wherein said oil thickener is selected from the group consisting of simple metal soaps, mixed base soaps, complex soaps, organo clay, polymers, polyurea, silica gel, carbon black, dyes, and mixtures thereof.

7. The lubricating composition of claim 2 wherein said salt-forming moiety is ammonium or a metal selected from the group consisting of lithium, sodium, potassium, cesium and rubidium.

8. The lubricating composition of claim 2 wherein said salt-forming moiety is potassium.

9. A lubricating composition comprising a major amount of a lubricant and a minor amount of a salt of tetrathiocarbonic acid of the form $M_2(CS_4)y$ wherein M is ammonium or a metal and y is the valence of M.

10. The lubricating composition of claim 9 wherein said lubricant comprises an oil of lubricating viscosity.

11. The lubricating composition of claim 9 wherein said lubricant is a grease comprised of an oil and between about 0.1 and about 30 weight percent of one or more oil thickeners.

12. The lubricating composition of claim 11 wherein said thickener is selected from the group consisting of simple metal soaps, mixed base soaps, complex soaps, organo clay, polymers, polyurea, silica gel, carbon black, dyes, and mixtures thereof.

13. The lubricating composition of claim 9 wherein M is a metal selected from the group consisting of lithium, sodium, potassium, cesium and rubidium and said minor amount is between about 0.1 and about 20 weight percent.

14. The lubricating composition of claim 9 wherein M is potassium.

15. A lubricating composition as defined in claim 9 comprising a mixture of:

at least 50 percent by weight of an oil of lubricating viscosity;

up to about 30 weight percent of one or more oil thickeners; and from about 0.1 to about 20 weight percent of said salt of tetrathiocarbonic acid.

16. The lubricating composition of claim 1 wherein said composition comprises an oil of lubricating viscosity and between about 0.5 and about 10 weight percent of an alkali metal salt of tetrathiocarbonic acid.

17. The lubricating composition of claim 16 wherein said alkali metal is selected from the group consisting of lithium, sodium, potassium, cesium and rubidium.

18. The lubricating composition of claim 15 wherein said oil thickener is present in an amount between about 3 and about 20 weight percent.

19. The lubricating composition of claim 18 wherein said oil thickener is selected from the group consisting of simple metal soaps, mixed base soaps, complex soaps, organo clay, polymers, polyurea, silica gel, carbon black, dyes, and mixtures thereof.

20. The lubricating composition of claim 18 wherein said thickener comprises a lithium soap, a lithium complex soap, or a mixture thereof.

21. A method of enhancing the lubrication of metal components subjected to sliding or rolling motion comprising lubricating said components with the lubricating composition of claim 1.

22. A method of enhancing the lubrication of metal components subjected to sliding or rolling motion comprising lubricating said components with the lubricating composition of claim 9.

23. The method of claim 22 wherein said lubricating composition comprises an oil of lubricating viscosity.

24. The method of claim 23 wherein said oil further comprises an oil thickener selected from the group consisting of simple metal soaps, mixed base soaps, complex soaps, organo clay, polymers, polyurea, silica gel, carbon black, dyes, and mixtures thereof.

25. The method of claim 22 wherein said lubricating composition further comprises a salt of tetrathiocarbonic acid of the form $M_2CS_4$ wherein M is a metal selected from the group consisting of lithium, sodium, potassium, cesium and rubidium.

26. The method of claim 25 wherein M is potassium.

27. The method of claim 25 wherein said salt is present in an amount between about 0.1 and about 20 weight percent.

28. A lubricating composition comprising a major amount of a lubricant and a minor amount of the reaction product of a mixture of a metal alkoxide, hydrogen sulfide, sulfur and carbon disulfide with said reaction product forming as a result of the reaction of equal moles of sulfur, carbon disulfide and hydrogen sulfide with 2 moles of the alkoxide moiety.

29. The lubricating composition of claim 28 wherein said metal alkoxide is the reaction product of an anhydrous alcohol with a metal selected from the group consisting of alkali and alkaline earth metals or with a metal hydroxide selected from the group consisting of alkali and alkaline earth hydroxides.

30. The lubricating composition of claim 28 wherein said alkoxide is potassium ethoxide.

31. The lubricating composition of claim 28 wherein said lubricant comprises an oil of lubricating viscosity.

32. The lubricating composition of claim 28 wherein said lubricant is a grease comprised of an oil and an oil thickener selected from the group consisting of simple metal soaps, mixed base soaps, complex soaps, organo clay, polymers, polyurea, silica gel, carbon black, dyes, and mixtures thereof.

33. The lubricating composition of claim 28 wherein said minor amount is between about 0.1 and about 20 weight percent.

34. The lubricating composition of claim 28 wherein said mixture comprises about equal molar amounts of sulfur, carbon disulfide and sulfide from said sulfide source for every two moles of said metal alkoxide.

35. A lubricating composition comprised of a major amount of a lubricant and a minor amount of a tetrathiocarbonate complex of the form:

$$(CI)_x(M_z(CS_4)_y)$$

wherein M is a cationic, complex-forming metal, z is the number of atoms of M in the complex, y is the number of tetathiocarbonate groups in the complex, CI is a neutralizing counter ion, and x is the number of counter ions necessary to neutralize the complex.

36. The lubricating composition of claim 35 wherein M is selected from the group consisting of lead, tin and the transition metals.

37. The lubricating composition of claim 35 wherein said metal is selected from the group consisting of iron, cobalt, nickel, platinum, copper, zinc, chromium, manganese and molybdenum.

38. The lubricating composition of claim 35 wherein M is selected from the group consisting of zinc, copper, iron and molybdenum.

39. The lubricating composition of claim 35 wherein said counter ion comprises ionic groups of the form:

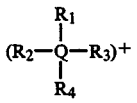

wherein Q is nitrogen or phosphorus and each R group is independently hydrogen or an organic radical.

40. The lubricating composition of claim 39 wherein each R group, when an organic radical, is independently selected from the group consisting of alkyl, aryl, cycloalkyl and alkylaryl groups, each of said groups having between 1 and about 50 carbon atoms.

41. The lubricating composition of claim 40 where each of said R groups is an organic radical.

42. The lubricating composition of claim 41 wherein each of said R groups is independently selected from phenyl and alkylaryl groups.

43. The lubricants composition of claim 35 wherein said lubricant comprises an oil of lubricating viscosity.

44. The lubricating composition of claim 35 wherein said lubricant is a grease comprised of an oil and an oil thickener.

45. The lubricating composition of claim 44 wherein said oil thickener is selected from the group consisting of simple metal soaps, mixed base soaps, complex soaps, organo clay, polymers, polyurea, silica gel, carbon black, dyes, and mixtures thereof.

46. The lubricating composition of claim 35 wherein said minor amount is between about 0.1 and about 20 weight percent.

47. A method of enhancing the lubrication of metal components subjected to sliding or rolling motion comprising lubricating said components with the lubricating composition of claim 35.

48. The method of claim 47 wherein said lubricating composition comprises an oil of lubricating viscosity.

49. The method of claim 47 wherein said lubricant is a grease comprised of an oil of lubricating viscosity and one or more oil thickeners.

50. The method of claim 49 wherein said oil thickener is selected from the group consisting of simple metal soaps, mixed base soaps, complex soaps, organo clay, polymers, polyurea, silica gel, carbon black, dyes, and mixtures thereof.

51. The method of claim 47 wherein said lubricating composition comprises a metal-tetrathiocarbonate complex in a concentration between about 0.1 and about 20 weight percent.

52. A lubricating composition comprising a major amount of a lubricant and a minor amount of a complex of tetrathiocarbonic acid, said complex being the reaction product of a mixture comprising an alkali metal salt of tetrathiocarbonic acid, a cationic complex-forming metallic moiety, and a counter ion.

53. The lubricating composition of claim 52 wherein said alkali metal is selected from the group consisting of lithium, sodium, potassium, cesium and rubidium.

54. The lubricating composition of claim 52 wherein said cationic complex-forming metallic moiety is selected from lead, tin and the transition metals.

55. The lubricating composition of claim 52 wherein said cationic complex-forming moiety is a transition metal selected from the group consisting of iron, cobalt, nickel, platinum, copper, zinc, chromium, manganese, and molybdenum.

56. The lubricating composition of claim 52 wherein said complex-forming metallic moiety is selected from the group consisting of zinc, molybdenum, copper and iron.

57. The lubricating composition of claim 52 wherein said counter ion comprises ionic groups of the form:

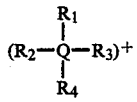

wherein Q is nitrogen or phosphorus and each R group is independently hydrogen or an organic radical.

58. The lubricating composition of claim 57 wherein each of said R groups, when an organic radical, is independently selected from the group consisting of alkyl, aryl, cycloalkyl, and alkylaryl groups, each of said groups having between 1 and about 50 carbon atoms.

59. The lubricating composition of claim 58 where each of said R groups is an organic radical.

60. The lubricating composition of claim 59 wherein each of said R groups is independently selected from phenyl and alkylaryl groups.

61. The lubricating composition of claim 52 wherein said lubricant is an oil of lubricating viscosity.

62. The lubricating composition of claim 52 wherein said lubricant is a grease comprised of an oil of lubricating viscosity and one or more oil thickeners.

63. The lubricating composition of claim 62 wherein said oil thickener is selected from the group consisting of simple metal soaps, mixed base soaps, complex soaps, organo clay, polymers, polyurea, silica gel, carbon black, dyes, and mixtures thereof.

* * * * *